United States Patent [19]

Hanada et al.

[11] Patent Number: 4,895,829

[45] **Date of Patent: * Jan. 23, 1990**

[54] HEAT-SENSITIVE RECORDING MEDIUM

[75] Inventors: Kazuyuki Hanada, Washinomiya; Susumu Nakamura, Kawagoe, both of Japan

[73] Assignees: Dainichiseika Color & Chemicals Mfg. Co., Ltd.; Ukima Colour & Chemicals Mfg. Co., Ltd., both of Tokyo, Japan

[ * ] Notice: The portion of the term of this patent subsequent to Sep. 19, 1988 has been disclaimed.

[21] Appl. No.: 86,783

[22] Filed: Aug. 19, 1987

[51] Int. Cl.[4] ..... B41M 5/035; B41M 5/26

[52] U.S. Cl. ..... 503/227; 8/471; 428/195; 428/423.1; 428/425.1; 428/447; 428/488.4; 428/913; 428/914

[58] Field of Search ..... 8/471; 428/423.1, 425.1, 428/447, 913, 488.4, 195, 914; 503/227

[56] References Cited

U.S. PATENT DOCUMENTS 4,572,860 2/1986 Nakamura et al. ..... 8/471
4,735,860 4/1988 Mizobuchi et al. ..... 428/423.1

FOREIGN PATENT DOCUMENTS 58-187396 11/1983 Japan ..... 428/423.1

*Primary Examiner*—Bruce H. Hess
*Attorney, Agent, or Firm*—Oblon, Spivak, McClelland, Maier & Neustadt

[57] ABSTRACT

A heat-sensitive recording medium is composed of a base sheet, a heat-sensitive recording layer provided on one side of the base sheet and a heat-resistant layer provided on the other side of the base sheet. The heat-resistant layer is made of a film-forming resin modified with a modifier, which is a reaction product of a silicone compound containing at least one reactive organic functional group and an organic polyisocyanate.

3 Claims, No Drawings

HEAT-SENSITIVE RECORDING MEDIUM

BACKGROUND OF THE INVENTION (1) Field of the Invention

This invention relates to a heat-sensitive recording medium, and more specifically to a heat-sensitive recording medium useful in the practice of the thermal ink-transfer recording or sublimation ink-transfer recording method.

(2) Description of the Prior Art

It has heretofore been known to have a dye or pigment carried along with a binder resin on one side of a sheet-like base material such as polyester film to form a heat-sensitive recording layer and to heat the heat-sensitive recording layer in a desired pattern by way of the back side of the base material to transfer the ink onto a material to be printed. It has also been known to use a thermally-sublimable dye as the above dye and to transfer the dye alone in a similar manner onto a material to be printed.

Since thermal energy is applied through the back side of a sheet-like base material in such conventional methods, the back side of the sheet-like base material is required to have sufficient heat resistance so that a thermal head does not stick on the back side.

It has hence been practised in the prior art to form a layer of a resin having relatively good heat resistance, for example, a polyurethane resin, acrylic resin, modified cellulose resin or a mixture thereof on the back side of a sheet-like base material of a heat-sensitive recording medium.

Although such conventional heat-sensitive recording media are provided on the back sides thereof with a heat-resistant layer of such a resin as mentioned above, these resins are thermoplastic and do not have sufficient resistance to heat. They are thus accompanied by a drawback that they tend to stick a thermal head to render insufficient the release of the thermal head from the heat-sensitive recording medium.

It has been attempted to incorporate an inorganic filler such as talc or fluoroplastic powder in such a heat-resistant layer with a view toward providing a solution to these drawbacks. Heat-resistant layers containing such an additive are however accompanied by drawbacks that due to the existence of such powder on their surfaces too, thermal heads are subjected to considerable smearing and wearing and their service life is shortened substantially in spite of their high price.

These various drawbacks can be solved by using a resin whose softening point is very high. There is however no suitable solvent for so-called heat-resistant resins known to date, so that difficulties still remain regarding their application on sheet-like base materials. Even if they can be applied, layers formed of these conventional heat-resistant resins have insufficient adhesion to sheet-like base materials and moreover are hard and brittle. It has hence been unable to form heat-resistant layers equipped with sufficient flexibility.

It has hence been desired to develop a resin having not only excellent flexibility but also superb heat resistance so that the above-mentioned problems can be solved.

SUMMARY OF THE INVENTION

The present inventors have carried out an extensive investigation with a view toward solving the above-mentioned drawbacks of the prior art and meeting the above desire. As a result, it has been found that the above object of this invention can be achieved by using a resin, which has been modified with a particular modifier, for the formation of a heat-resistant layer.

In one aspect of this invention, there is thus provided a heat-sensitive recording medium composed of a base sheet, a heat-sensitive recording layer provided on one side of the base sheet and a heat-resistant layer provided on the other side of the base sheet. The heat-resistant layer is made of a film-forming resin modified with a modifier which is a reaction product of a silicone compound containing at least one reactive organic functional group and an organic polyisocyanate.

In the heat-sensitive recording medium of this invention, the heat-resistant layer has such high heat resistance and low stickiness under heat that no prior art technique can achieve, while retaining various properties inherent to a film-forming resin employed, for example, solubility, flexibility, strength, and other electrical, chemical and physical properties. The heat-resistant layer of the heat-sensitive recording medium of this invention is not softened or rendered sticky by heat from a thermal head in contrast to prior art heat-sensitive recording media. The heat-sensitive recording medium of this invention can therefore be used with extreme stability so that the drawbacks of the prior art have been solved.

Further, the modifier useful in the practice of this invention is not limited to the modification of certain specific resins but is applicable freely for the modification of any film-forming resins. This feature has led to a further advantage that the present invention can provide, without increasing the production cost, heat-sensitive recording media having a heat-resistant layer which is formed of a desired one of various film-forming resins and has high heat resistance and low stickiness under heat.

Since the heat-resistant layer of the heat-sensitive recording medium of this invention is formed of a film-forming resin modified with such a modifier as mentioned above, the modifier contained in the heat-resistant layer is polymerized or is reacted and coupled with the film-forming resin by way of polar groups such as urethane bonds or urea bonds after the formation of the heat-resistant layer. The present invention has hence solved the drawback of the prior art that heat-resistant particles are allowed to bleed out to the surface of the heat-resistant layer as the time goes on and hence smear and wear a thermal head.

The above and other objects, features and advantages of the present invention will become apparent from the following description and the appended claims.

DETAILED DESCRIPTION OF THE INVENTION AND PREFERRED EMBODIMENTS

The modifier for the film-forming resin, which modifier is useful in the practice of this invention and is a first feature of the present invention, is a reaction product of a silicone compound containing at least one reactive organic functional group and an organic polyisocyanate. As a typical example, the reaction product may be substantially free of free isocyanate group or may contain at least one free isocyanate group.

The silicone compound containing at least one reactive organic group, which is used to obtain such a modifier, may be any silicone compound so long as it contains at least one group reactive with an isocyanate group, such as amino group, carboxyl group, hydroxyl group or thioalcohol residuum. Particularly preferred examples may include silicone compounds represented by the following formulae: .

(1) Amino-modified silicone oils:

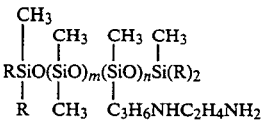

(m = 1–10, n = 2–10, R = $CH_3$ or $OCH_3$)

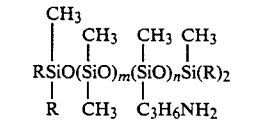

(m = 1–10, n = 2–10, R = $CH_3$ or $OCH_3$)

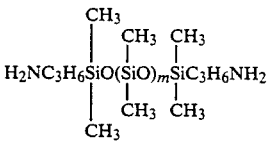

(m = 0–200)

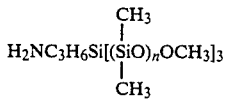

(n = 2–10)

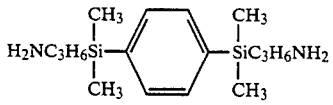

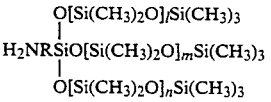

(degree of branching = 2–3, R = lower alkyl group, l = 2–200, m = 2–200, n = 2–200)

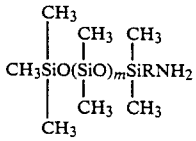

(m = 1–200, R: lower alkyl group)

(2) Epoxy-modified silicone oils:

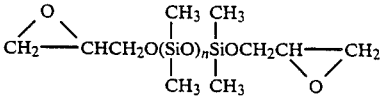

(n = 1–200)

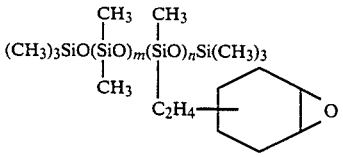

(m = 1–10, n = 2–10)

-continued

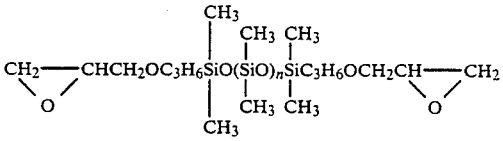

(n = 1–200)

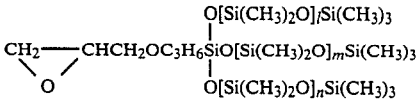

(degree of branching = 2–3, R = lower alkyl group, l = 2–200, m = 2–200, n = 2–200)

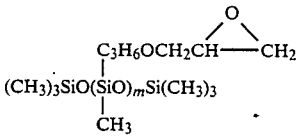

(n = 1–10)

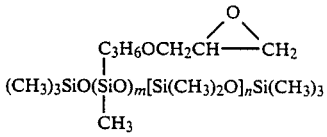

(m = 1–10, n = 2–10)

(3) Alcohol-modified silicone oils:

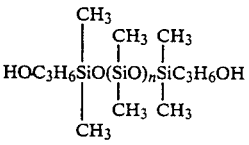

(n = 1–200)

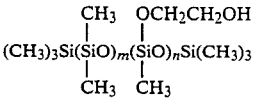

(m = 1–10, n = 2–10)

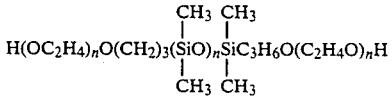

(n = 0–200)

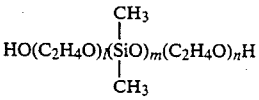

(l = 1–10, m = 10–200, n = 1–5)

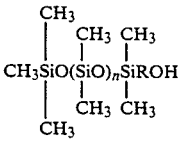

(n = 1–200, R = lower alkyl group)

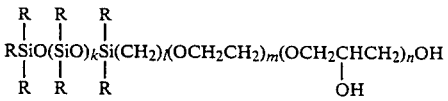

(R = alkyl group, k = 1–250, l = 0–5, m = 0–3, n = 1–3)

(4) Mercapto-modified silicone oils:

-continued

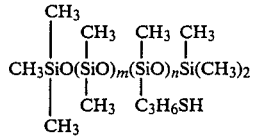

(m = 1-10, n = 2-10)

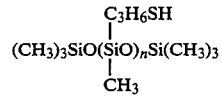

(n = 2-10)

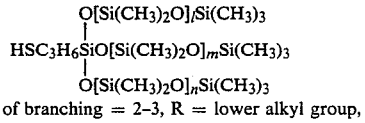

(degree of branching = 2-3, R = lower alkyl group, l = 2-200, m = 2-200, n = 2-200)

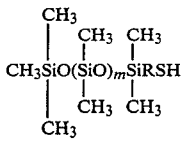

(n = 1-200, R = lower alkyl group)

(5) Carboxyl-modified silicone oils:

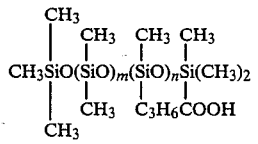

(m = 1-10, n = 2-10)

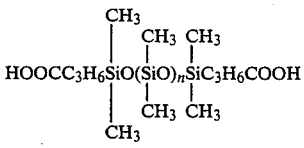

(n = 1-200)

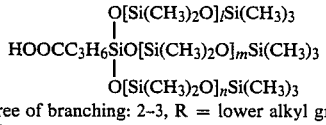

(degree of branching: 2-3, R = lower alkyl group, l = 2-200, m = 2-200, n = 2-200)

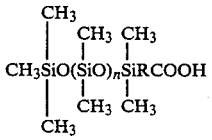

(n = 1-200, R = lower alkyl group)

The above-exemplified silicone compounds having at least one reactive organic functional group are illustrative examples of silicone compounds preferred in the present invention. The present invention is hence not necessarily limited to the use of these exemplified silicone compounds. The above-exemplified compounds and other silicone compounds are presently sold on the market and are thus readily available on the market. They are all usable in the present invention.

The organic polyisocyanate, which is also useful in the practice of the present invention and is a second feature of the present invention, is an aliphatic or aromatic compound containing at least two isocyanate groups and has been used widely as a raw material for the synthesis of polyurethane resins.

These conventionally-known organic polyisocyanates are all usable in the present invention. The following organic polyisocyanates may be mentioned as especially preferred organic polyisocyanates.

Toluene-2,4-diisocyanate;
4-Methoxy-1,3-phenylenediisocyanate;
4-Isopropyl-1,3-phenylenediisocyanate; 4-Chloro-1,3-phenylenediisocyanate;
4-Butoxy-1,3-phenylenediisocyanate;
2,4-Diisocyanato diphenyl ether;
Mesitylenediisocyanate;
4,4-Methylenebis(phenyl isocyanate);
Durylenediisocyanate;
1,5-Naphthalenediisocyanate;
Benzidinediisocyanate;
o-Nitrobenzidinediisocyanate;
4,4-Diisocyanato-dibenzyl;
1,4-Tetramethylenediisocyanate;
1,6-Tetramethylenediisocyanate;
1,10-Decamethylenediisocyanate;
1,4-Cyclohexylenediisocyanate;
Xylylenediisocyanate;
4,4-Methylenebis(cyclohexylisocyanate);
1,5-Tetrahydronaphthalenediisocyanate; etc.

In addition, adducts of these organic polyisocyanates with other compounds, for example, those having the following structural formulae may also be mentioned, although not necessarily limited thereto.

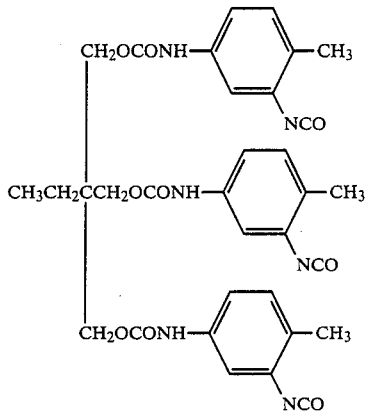

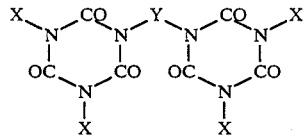

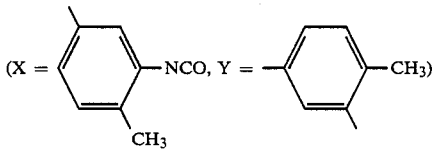

-continued

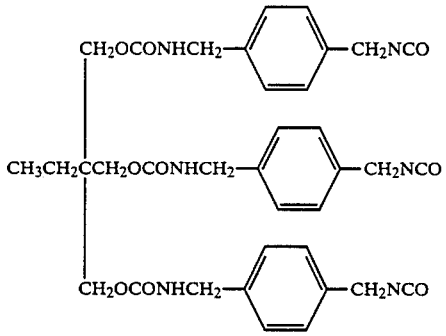

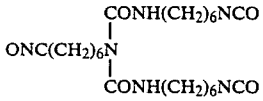

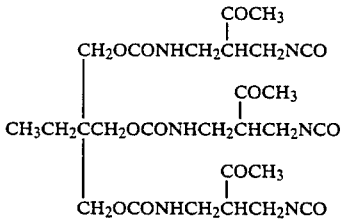

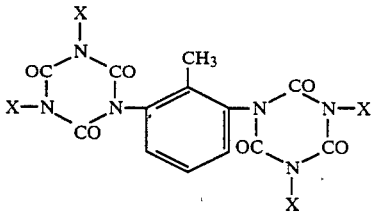

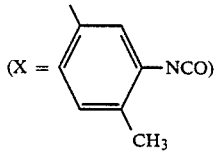

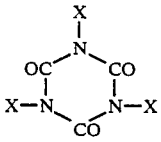

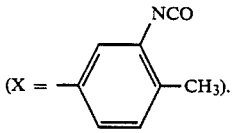

Where the modifier to be used in this invention does not contain any free isocyanate group, the modifier can be obtained with ease by reacting a silicone compound having at least one reactive organic functional group, such as that mentioned above, and such an organic polyisocyanate as mentioned above at such a ratio of the reactive organic groups to isocyanate groups not allowing any isocyanate groups to remain after the reaction, preferably, at a functional group ratio of 1:1, in the presence or absence of an organic solvent and catalyst, at about 0°-150° C., preferably, 20°≅80° C. for about 10 minutes-3 hours.

Where the modifier to be used in this invention contains at least one free isocyanate group, the modifier can also be obtained with ease by reacting a silicone compound having at least one reactive organic functional group, such as that mentioned above, and such an organic polyisocyanate as mentioned above at such a functional group ratio of the reactive organic groups to isocyanate groups that at least one, preferably, 1-2 excess isocyanate groups are contained per molecule, in the presence or absence of an organic solvent and catalyst, at about 0°-150° C., preferably, 20°-80° C. for about 10 minutes-3 hours.

Any organic solvent may be used upon preparation of such a modifier so long as the organic solvent is inert to both starting materials and the reaction product. As preferable exemplary organic solvents, may be mentioned methyl ethyl ketone, methyl n-propyl ketone, methyl isobutyl ketone, diethyl ketone, methyl formate, ethyl formate, propyl formate, methyl acetate, ethyl acetate, butyl acetate, acetone, cyclohexane, tetrahydrofuran, dioxane, methanol, ethanol, isopropyl alcohol, butanol, methyl cellosolve, butyl cellosolve, cellosolve acetate, dimethylformamide, dimethylsulfoxide, pentane, hexane, cyclohexane, heptane, octane, mineral spirit, petroleum ether, gasoline, benzene, toluene, xylene, chloroform, carbon tetrachloride, chlorobenzene, perchloroethylene, and trichloroethylene.

When prepared in the above-described manner by using such an organic solvent, the modifier may be used after its separation from the organic solvent or as is, namely, as a solution in the organic solvent. After separation from the organic solvent, the modifier useful in the practice of this invention is generally in a white to brown liquid or solid form and is highly soluble in various organic solvents.

In accordance with various analyses, for example, infrared absorption spectroscopy, elemental analysis and molecular weight measurement, it has been found that the above-mentioned modifier, which is useful in the practice of this invention and contains no free isocyanate group, is formed by an addition reaction of the isocyanate groups of the organic polyisocyanate with the reactive organic functional group of the silicone compound, and where the reactive organic functional group is an amino group for example, the organic polyisocyanate and silicone compound are coupled together by a urea bond (—NHCONH—) and the resultant reaction product is substantially free of free isocyanate groups.

As a result of various analyses, for example, infrared absorption spectroscopy, elemental analysis and molecular weight measurement, it has also been found that the modifier, which contains at least one free isocyanate group, is formed by an addition reaction of the isocyanate groups of the organic polyisocyanate with the reactive organic functional group of the silicone compound, and where the reactive organic functional group is an amino group for example, the organic polyisocyanate and silicone compound are coupled together through a urea bond (—NHCONH—) and the resultant reaction product contains at least one free isocyanate group per molecule.

The film-forming resin which is modified by the above modifier upon practice of this invention is a desired one of various film-forming resins known to date. These conventionally-known film-forming resins are all usable in the present invention. Illustrative examples may include vinyl chloride resins, vinylidene chloride resins, vinyl chloride/vinyl acetate/vinyl alcohol copolymer resins, alkyd resins, epoxy resins, acrylonitrile-butadiene resins, polyurethane resins, polyurea resins, nitrocellulose resins, polybutyral resins, polyester resins, fluoroplastics, melamine resins, urea resins, acrylic resins, polyamide resins, and so on. Particularly preferred are polyurethane resins which contain a urea bond or urethane bond in their structures. These resins may all be used either singly or in combination, in the form of either solution or dispersion in an organic solvent.

When the above-described film-forming resin is modified with a modifier containing no free isocyanate group out of the modifiers described above, the modification of the film-forming resin can be achieved by simply mixing it with the modifier. When a modifier containing one or more free isocyanate groups is used, the modification may be effected in the same manner. It is however preferable to use, as the film-forming resin, a reactive resin which contains hydroxyl, amino, carboxyl groups by way of example. In this case, the modifier reacts with the film-forming resin and is incorporated as pendant groups in the film-forming resin. When the thus-modified film-forming resin is formed into heat-resistant layers, the heat resistance of the heat-resistant layers and their non-sticking property under heat can be improved significantly without deterioration to a variety of inherent good properties, e.g., solubility and flexibility, of the film-forming resin. The above reaction between the film-forming resin and modifier can be easily carried out by reacting them in the presence or absence of an organic solvent and catalyst, at about 0°–150° C., preferably, 20°–80° C. for about 10 minutes–3 hours.

The reaction between the modifier and film-forming resin can be effected in any stage, for example, before, during or after the preparation of a coating formulation, or during or after the formation of the heat-resistant layer. Even when the film-forming resin does not contain any group reactive with an isocyanate group, the molecular weight of the modifier increases to exhibit similar effects provided that the modifier is allowed to undergo a polymerization reaction or water or a polyfunctional compound such as polyamine is added in advance to the coating formulation.

For the formation of the heat-resistant layer, it is preferable to use a coating formulation prepared by either dissolving or dispersing the film-forming resin, which has been modified with the above-described modifier, in such a solvent as described above. The concentration of the film-forming resin in the coating formulation may preferably be from about 10 to 55 wt. % or so. The modifier may be used in a proportion of about 1–100 parts by weight per 100 parts by weight of the film-forming resin.

So long as the coating formulation, which is employed in the present invention to form the heat-resistant layer, contains the above component as an essential component, it may additionally contain auxiliary components other than the above component, for example, desired additives such as pigment, extender pigment, plasticizer, antistatic agent, surfactant, lubricant, cross-linking agent, age resister, stabilizer, foaming agent and/or defoaming agent.

The formation of the heat-resistant layer may itself be carried out by any one of methods known to date. It is preferable to form the heat-resistant layer to a thickness of about 0.1–10 μm.

Conventional sheet-like base materials are all usable in the present invention. For example, 5–50 μm thick polyester films, polypropylene films, cellulose triacetate films, cellulose diacetate films, polycarbonate films and the like can be used as desired.

Except for the use of the film-forming resin modified with such a modifier as mentioned above for the formation of the heat-resistant layer, the heat-sensitive recording medium of this invention can be produced by depending fully on techniques known to date. The heat-sensitive recording layer can be formed from a binder resin, dye or pigment, organic solvent and various additives as needed, all of which have been known to date, by following techniques also known to date.

As the binder resin for example, it is possible to use a resin such as the aforementioned film-forming resin. An organic solvent similar to the above-described organic solvent may also be used as the organic solvent. Additives may also be similar to those mentioned above. As the pigment, it is possible to use, for example, an organic pigment such as azo, phthalocyanine, quinacridone or polycyclic pigment or an inorganic pigment such as carbon black, iron oxide, chrome yellow or cadmium sulfide. Any one of various dyes known to date, sublimable dyes and disperse dyes may be used as the dye.

The present invention will hereinafter be described more specifically by the following Referential Examples, Examples, Comparative Examples and Application Example, in which all designations of "part" or "parts" and "%" refer to part or parts by weight and wt. %. Referential Example 1 (preparation of modifier):

While thoroughly stirring at 50° C. 175 parts of an adduct of trimethylolpropane and tolylenediisocyanate (TDI) at a molar ratio of 1:3 ("Colonate L", trade name; product of Nippon Polyurethane Industry Co., Ltd.; NCO %: 12.5; solid content: 75%), were slowly dropped 1,320 parts of aminopropyl-terminated polydimethylsiloxane (molecular weight: 2,200) having the following structure so as to react them to each other.

$$H_2NC_3H_6Si[(O\overset{\overset{CH_3}{|}}{\underset{\underset{CH_3}{|}}{Si}})_nOCH_3]_3$$

(n=a value to give a molecular weight of 2,200)

After the reaction, ethyl acetate was caused to evaporate to obtain 1,440 parts of a modifier (M1) in a clear liquid form.

An infrared absorption spectrum of the modifier did not show any absorption corresponding to free isocyanate groups at 2270 $cm^1$ but contained an absorption band corresponding to Si—O—C groups at 1090 $cm^{-1}$.

Accordingly, the principal structure of the above modifier is estimated to have the following formula:

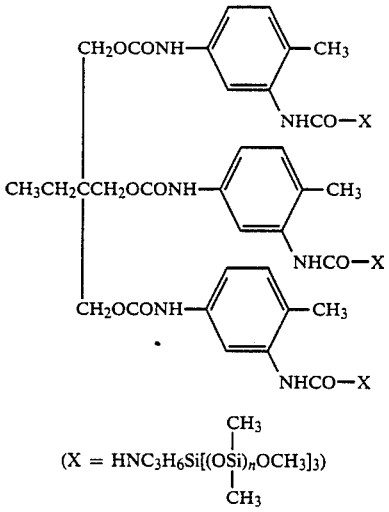

Referential Example 2 (preparation of modifier):

Twenty four parts of phenyl isocyanate were added to 196 parts of hydroxypropyl-terminated polydimethylsiloxane (molecular weight: 980) having a structure to be described blow, and the resultant mixture was stirred thoroughly at 60° C. to react them to each other, thereby obtaining 213 parts of a reaction product (A) in a clear liquid form.

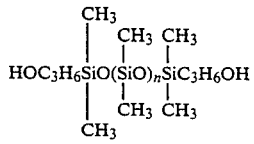

(n=a value to give a molecular weight of 980)

While thoroughly stirring at 60° C. 52 parts of an adduct of hexamethylenediisocyanate and water ("Duranate 24A-100", trade name; product of Asahi Chemical Industry Co., Ltd.; NCO %: 23.5), 330 parts of the above reaction product (A) were slowly added dropwise to obtain 376 parts of a modifier (M2) in the form of a colorless clear liquid. In an infrared absorption spectrum of the modifier, absorption corresponding to free isocyanate groups was no longer observed at 2270 $cm^{-1}$ but an absorption band corresponding to Si—O—C groups was observed at 1090 $cm^{-1}$. Accordingly, the principal structure of the above modifier is estimated to have the following formula:

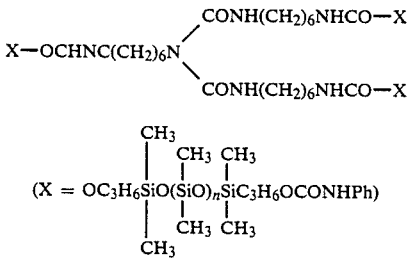

Referential Example 3 (preparation of modifier): To 230 parts of aminopropyl-terminated polydimethylsiloxane (molecular weight: 1,150) having a structure to be described below, were added 15 parts of n-butylaldehyde. The resultant mixture was thoroughly stirred at 80° C. to react them to each other. The reaction was allowed to proceed for 3 hours while taking the resulting water out of the reaction system under reduced pressure, thereby obtaining 238 parts of a reaction product (B) in a clear liquid form.

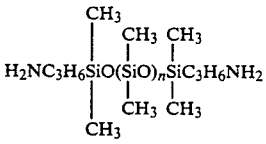

(n=a value to give a molecular weight of 1,150)

While thoroughly stirring at room temperature parts of an adduct of trimethylolpropane and xylenediisocyanate at a molar ratio of 1:3 ("Takenate D110N", trade name; product of Takeda Chemical Industries, Ltd.; NCO %: 11.5; solid content: 75%), were slowly dropped 735 parts of the above reaction product (B) to react them to each other at 60° C.

After the reaction, ethyl acetate was caused to evaporate so that 905 parts of a modifier (M3) in a clear liquid form were obtained.

In an infrared absorption spectrum of the modifier, absorption corresponding to free isocyanate groups was no longer observed at 2270 $cm^{-1}$ but an absorption band corresponding to Si—O—C groups was observed at 1090 $cm^{-1}$.

Accordingly, the principal structure of the above modifier is estimated to have the following formula:

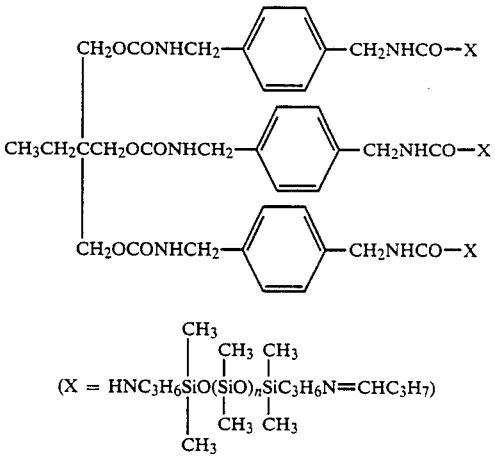

Referential Example 4 (preparation of modifier):

While thoroughly stirring at 60° C. 35 parts of 2,6-tolylenediisocyanate and 110 parts of ethyl acetate, were slowly dropped 632 parts of mercaptopropyl-terminated polydimethylsiloxane (molecular weight: 1,580) having the following structure:

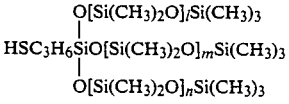

(l, m, n=values to give a molecular weight of 1,580)

After the reaction, ethyl acetate was caused to evaporate to obtain 661 parts of a modifier (M4) in a clear liquid form.

In an infrared absorption spectrum of the modifier, absorption corresponding to free isocyanate groups was no longer observed at 2270 $cm^{-1}$ but an absorption band corresponding to Si—O—C groups was observed at 1090 $cm^{-1}$.

Accordingly, the principal structure of the above modifier is estimated to have the following formula:

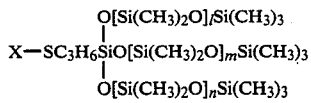

(l, m, n = values to give a molecular weight of 1,580)

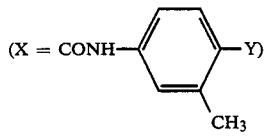

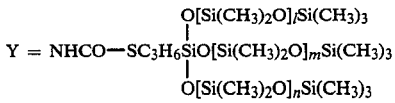

Referential Example 5 (preparation of modifier):

While thoroughly stirring at 60° C. 24 parts of phenyl isocyanate and 160 parts of ethyl acetate, 450 parts of hydroxypropyl-terminated polydimethylsiloxane (molecular weight: 2,250) having a structure to be described below were slowly added dropwise to conduct a reaction.

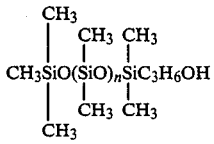

(n=a value to give a molecular weight of 1,580)

After the reaction, ethyl acetate was caused to evaporate to obtain 467 parts of a modifier (M5) in a clear liquid form.

In an infrared absorption spectrum of the modifier, absorption corresponding to free isocyanate groups was no longer observed at 2270 $cm^{-1}$ but an absorption band corresponding to Si—O—C groups was observed at 1090 $cm^{-1}$.

Accordingly, the principal structure of the above modifier is estimated to have the following formula:

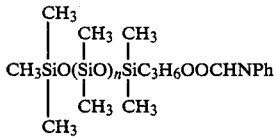

Referential Example 6 (preparation of modifier):

While thoroughly stirring at 50° C. 175 parts of an adduct of trimethylolpropane and tolylenediisocyanate (TDI) at a molar ratio of 1:3 ("Colonate L", trade name; product of Nippon Polyurethane Industry Co., Ltd.; NCO %: 12.5; solid content: 75%), were slowly dropped 880 parts of aminopropyl-terminated polydimethylsiloxane (molecular weight: 2,200) having the following structure so as to react them to each other.

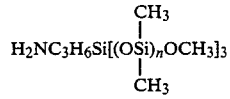

(n=a value to give a molecular weight of 2,200)

After the reaction, ethyl acetate was caused to evaporate to obtain 976 parts of a modifier (M6) in a clear liquid form.

In an infrared absorption spectrum of the modifier, absorption corresponding to free isocyanate groups was still observed at 2270 $cm^{-1}$ and an absorption band corresponding to Si—O—C groups was also observed at 1090 $cm^{-1}$.The free isocyanate groups in the modifier was quantitatively analyzed. The content of free isocyanate groups was found to be 0.78% although it is calculated to be 0.83%.

Accordingly, the principal structure of the above modifier is estimated to have the following formula:

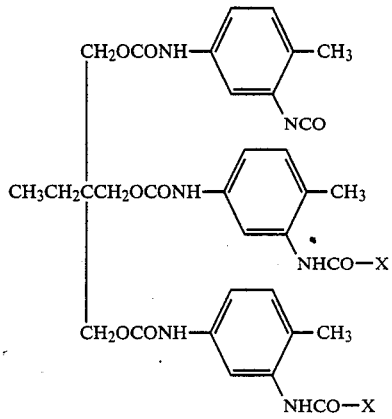

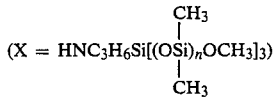

Referential Example 7 (preparation of modifier):

Twenty four parts of phenyl isocyanate were added to 196 parts of hydroxypropyl-terminated polydimethylsiloxane (molecular weight: 980) having a structure to be described blow, and the resultant mixture was stirred thoroughly at 60° C. to react them to each other, thereby obtaining 213 parts of a reaction product (A) in a clear liquid form.

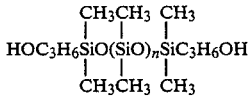

(n=a value to give a molecular weight of 980)

While thoroughly stirring at 60° C. 52 parts of an adduct of hexamethylenediisocyanate and water ("Duranate 24A-100", trade name; product of Asahi Chemical Industry Co., Ltd.; NCO % 23.5), 220 parts of the above reaction product (A) were slowly added dropwise to obtain 263 parts of a modifier (M7) in the form of a colorless clear liquid.

In an infrared absorption spectrum of the modifier, absorption corresponding to free isocyanate groups was still observed at 2270 $cm^{-1}$ and an absorption band corresponding to Si—O—C groups was also observed at 1090 $cm^{-1}$. The free isocyanate groups in the modifier was quantitatively analyzed. The content of free isocyanate groups was found to be 1.37% although it is calculated to be 1.54%.

Accordingly, the principal structure of the above modifier is estimated to have the following formula:

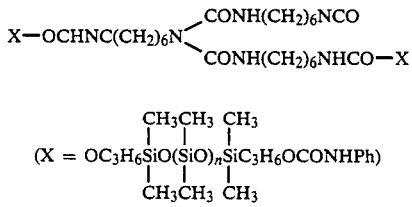

Referential Example 8 (preparation of modifier):

To 230 parts of aminopropyl-terminated polydimethylsiloxane (molecular weight: 1,150) having a structure to be described below, were added 15 parts of n-butylaldehyde. The resultant mixture was thoroughly stirred at 80° C. to react them to each other. The reaction was allowed to proceed for 3 hours while taking the resulting water out of the reaction system under reduced pressure, thereby obtaining 238 parts of a reaction product (B) in a clear liquid form.

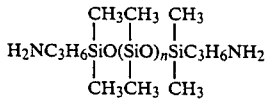

(n=a value to give a molecular weight of 1,150)

While thoroughly stirring at room temperature 186 parts of an adduct of trimethylolpropane and xylenediisocyanate at a molar ratio of 1:3 ("Takenate D110N", trade name; product of Takeda Chemical Industries, Ltd.; NCO %: 11.5; solid content: 75%), were slowly dropped 490 parts of the above reaction product (B) to react them to each other at 60° C.

After the reaction, ethyl acetate was caused to evaporate so that 610 parts of a modifier (M8) in a clear liquid form were obtained.

In an infrared absorption spectrum of the modifier, absorption corresponding to free isocyanate groups was still observed at 2270 $cm^{-1}$ and an absorption band corresponding to Si—O—C groups was also observed at 1090 $cm^{-1}$.The free isocyanate groups in the modifier was quantitatively analyzed. The content of free isocyanate groups was found to be 1.34% although it is calculated to be 1.25%.

Accordingly, the prineipal structure of the above modifier is estimated to have the following formula:

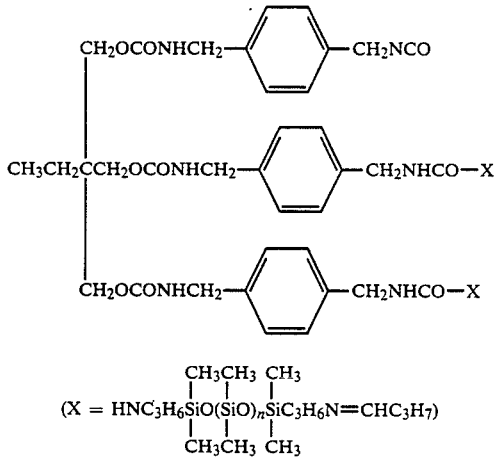

Referential Example 9 (preparation of modifier):

While thoroughly stirring at 60° C. 35 parts of 2,6-tolylenediisocyanate and 110 parts of ethyl acetate, were slowly dropped 316 parts of mercaptopropyl-terminated polydimethylsiloxane (molecular weight: 1,580) having the following structure:

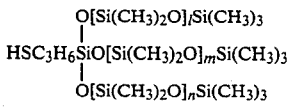

(l, m, n=values to give a molecular weight of 1,580)

After the reaction, ethyl acetate was caused to evaporate to obtain 340 parts of a modifier (M9) in a clear liquid form.

In an infrared absorption spectrum of the modifier, absorption corresponding to free isocyanate groups was still observed at 2270 $cm^{-1}$ and an absorption band corresponding to Si—O—C groups was also observed at 1090 $cm^{-1}$.The free isocyanate groups in the modifier was quantitatively analyzed. The content of free isocyanate groups was found to be 2.12% although it is calculated to be 2.39%.

Accordingly, the principal structure of the above modifier is estimated to have the following formula:

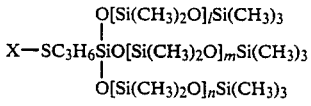

(l, m, n=values to give a molecular weight of 1,580)

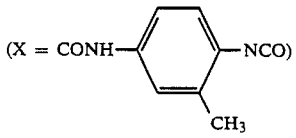

Referential Example 10 (preparation of modifier):

While thoroughly stirring at 60° C. 52 parts of hexamethylenediisocyanate and 160 parts of ethyl acetate, 450 parts of hydroxypropyl-terminated polydimethylsiloxane (molecular weight: 2,250) having a structure to be described below were slowly added dropwise to conduct a reaction.

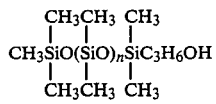

(n=a value to give a molecular weight of 1,580)

After the reaction, ethyl acetate was caused to evaporate to obtain 488 parts of a modifier (M10) in a clear liquid form.

In an infrared absorption spectrum of the modifier, absorption corresponding to free isocyanate groups was still observed at 2270 $cm^{-1}$ and an absorption band corresponding to Si—O—C groups was also observed at 1090 $cm^{-1}$.The free isocyanate groups in the modifier was quantitatively analyzed. The content of free isocyanate groups was found to be 1.52% although it is calculated to be 1.67%.

Accordingly, the principal structure of the above modifier is estimated to have the following formula:

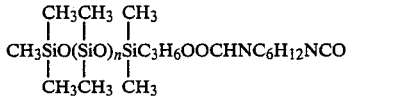

Referential Example 11 (preparation of liquid formulation of film-forming resin):

Subjected to an addition reaction in 412 parts of methyl ethyl ketone were 150 parts of hydroxyl-terminated polybutyleneadipate having a molecular weight of 2,000, 20 parts of 1,3-butylene glycol and 52 parts of tolylenediisocyanate, thereby obtaining a liquid polyurethane resin mixture (solid content: 35%) having a viscosity of 200 poise/20° C. Five parts of the modifier (M1) were added to 100 parts of the liquid polyurethane resin mixture so as to obtain a liquid formulation (UF1) of a modified film-forming resin. Referential Example 12 (preparation of liquid formulation of film-forming resin):

A liquid formulation (UF2) of a modified film-forming resin was obtained in the same manner as in Referential Example 11 except that the modifier (M2) was used in lieu of the modifier (M1). Referential Example 13 (preparation of liquid formulation of film-forming resin):

A liquid formulation (UF3) of a modified film-forming resin was obtained in the same manner as in Referential Example 11 except that the modifier (M3) was used in lieu of the modifier (M1). Referential Example 14 (preparation of liquid formulation of film-forming resin):

A liquid formulation (UF4) of a modified film-forming resin was obtained in the same manner as in Referential Example 11 except that the modifier (M4) was used in lieu of the modifier (M1). Referential Example 15 (preparation of liquid formulation of film-forming resin):

A liquid formulation (UF5) of a modified film-forming resin was obtained in the same manner as in Referential Example 11 except that the modifier (M5) was used in lieu of the modifier (M1). Referential Example 16 (preparation of liquid formulation of film-forming resin):

Subjected to an addition reaction in 412 parts of methyl ethyl ketone were 150 parts of hydroxyl-terminated polybutyleneadipate having a molecular weight of 2,000, 20 parts of 1,3-butylene glycol and 52 parts of tolylenediisocyanate, thereby obtaining a liquid polyurethane resin mixture (solid content: 35%) having a viscosity of 200 poise/20° C. Five parts of the modifier (M6) were added to 100 parts of the liquid polyurethane resin mixture, followed by a reaction at 80° C. for 3 hours. A liquid formulation (UF6) of a modified film-forming resin in which the modifier and polyurethane resin were bonded together was obtained. An infrared absorption spectrum did not show any isocyanate groups in the film-forming resin obtained above. It is hence estimated that the modifier was grafted on the film-forming resin. Referential Example 17 (preparation of liquid formulation of film-forming resin):

A liquid formulation (UF7) of a modified film-forming resin was obtained in the same manner as in Referential Example 16 except that the modifier (M7) was used in lieu of the modifier (M6). Referential Example 18 (preparation of liquid formulation of film-forming resin):

A liquid formulation (UF8) of a modified film-forming resin was obtained in the same manner as in Referential Example 16 except that the modifier (M8) was used in lieu of the modifier (M6). Referential Example 19 (preparation of liquid formulation of film-forming resin):

A liquid formulation (UF9) of a modified film-forming resin was obtained in the same manner as in Referential Example 16 except that the modifier (M9) was used in lieu of the modifier (M6). Referential Example 20 (preparation of liquid formulation of film-forming resin):

A liquid formulation (UF10) of a modified film-forming resin was obtained in the same manner as in Referential Example 16 except that the modifier (M10) was used in lieu of the modifier (M6). Referential Example 21 (preparation of liquid formulation of film-forming resin):

Three parts of the modifier (M1) obtained in Referential Example 1 were added to 100 parts of a methyl ethyl ketone solution (solid content: 30%) of a vinyl chloride/vinyl acetate/vinyl alcohol copolymer resin ("Eslek A", trade name; product of Sekisui Chemical Co., Ltd.), thereby obtaining a liquid formulation (VF1) of a modified film-forming resin. Referential Example 22 (preparation of liquid formulation of film-forming resin):

A liquid formulation (VF2) of a modified film-forming resin was obtained in the same manner as in Referential Example 21 except that the modifier (M2) was used in lieu of the modifier (M1). Referential Example 23 (preparation of liquid formulation of film-forming resin):

A liquid formulation (VF3) of a modified film-forming resin was obtained in the same manner as in Referential Example 21 except that the modifier (M3) was used in lieu of the modifier (M1). Referential Example 24 (preparation of liquid formulation of film-forming resin):

A liquid formulation (VF4) of a modified film-forming resin was obtained in the same manner as in Referential Example 21 except that the modifier (M4) was used in lieu of the modifier (M1). Referential Example 25 (preparation of liquid formulation of film-forming resin):

A liquid formulation (VF5) of a modified film-forming resin was obtained in the same manner as in Referential Example 21 except that the modifier (M5) was used in lieu of the modifier (M1). Referential Example 26 (preparation of liquid formulation of film-forming resin):

Three parts of the modifier (M6) obtained in Referential Example 6 were added to 100 parts of a methyl ethyl ketone solution (solid content: 30%) of a vinyl chloride/vinyl acetate/vinyl alcohol copolymer resin ("Eslek A", trade name; product of Sekisui Chemical Co., Ltd.), followed by a reaction at 80° C. for 3 hours. A liquid formulation (VF6) of a modified film-forming resin in which the modifier and vinyl resin were bonded together was obtained.

An infrared absorption spectrum did not show any isocyanate groups in the film-forming resin obtained above. It is hence estimated that the modifier was grafted on the film-forming resin. Referential Example 27 (preparation of liquid formulation of film-forming resin):

A liquid formulation (VF7) of a modified film-forming resin was obtained in the same manner as in Referential Example 26 except that the modifier (M7) was used in lieu of the modifier (M6). Referential Example 28 (preparation of liquid formulation of film-forming resin):

A liquid formulation (VF8) of a modified film-forming resin was obtained in the same manner as in Referential Example 26 except that the modifier (M8) was used in lieu of the modifier (M6). Referential Example 29 (preparation of liquid formulation of film-forming resin):

A liquid formulation (VF9) of a modified film-forming resin was obtained in the same manner as in Referential Example 26 except that the modifier (M9) was used in lieu of the modifier (M6). Referential Example 30 (preparation of liquid formulation of film-forming resin):

A liquid formulation (VF10) of a modified film-forming resin was obtained in the same manner as in Referential Example 26 except that the modifier (M10) was used in lieu of the modifier (M6). Referential Example 31 (preparation of coating formulation for heat-resistant layer):

A coating formulation (UC1) for a heat-resistant layer was prepared by mixing and dissolving the following components:

| | |
|---|---|
| Liquid formulation (UF1) of the film-forming resin (30% solution) | 100 parts |
| Methyl ethyl ketone | 100 parts |

Referential Example 32 (preparation of coating formulation for heat-resistant layer):

A coating formulation (UC2) for a heat-resistant layer was prepared by mixing and dissolving the following components:

| | |
|---|---|
| Liquid formulation (UF2) of the film-forming resin (30% solution) | 100 parts |
| Methyl ethyl ketone | 100 parts |

Referential Example 33 (preparation of coating formulation for heat-resistant layer):

A coating formulation (UC3) for a heat-resistant layer was prepared by mixing and dissolving the following components:

| | |
|---|---|
| Liquid formulation (UF3) of the film-forming resin (30% solution) | 100 parts |
| Methyl ethyl ketone | 100 parts |

Referential Example 34 (preparation of coating formulation for heat-resistant layer):

A coating formulation (UC4) for a heat-resistant layer was prepared by mixing and dissolving the following components:

| | |
|---|---|
| Liquid formulation (UF4) of the film-forming resin (30% solution) | 100 parts |
| Methyl ethyl ketone | 100 parts |

Referential Example 35 (preparation of coating formulation for heat-resistant layer):

A coating formulation (UC5) for a heat-resistant layer was prepared by mixing and dissolving the following components:

| | |
|---|---|
| Liquid formulation (UF5) of the film-forming resin (30% solution) | 100 parts |
| Methyl ethyl ketone | 100 parts |

Referential Example 36 (preparation of coating formulation for heat-resistant layer):

A coating formulation (UC6) for a heat-resistant layer was prepared by mixing and dissolving the following components:

| | |
|---|---|
| Liquid formulation (UF6) of the film-forming resin (30% solution) | 100 parts |
| Methyl ethyl ketone | 100 parts |

Referential Example 37 (preparation of coating formulation for heat-resistant layer):

A coating formulation (UC7) for a heat-resistant layer was prepared by mixing and dissolving the following components:

| | |
|---|---|
| Liquid formulation (UF7) of the film-forming resin (30% solution) | 100 parts |
| Methyl ethyl ketone | 100 parts |

Referential Example 38 (preparation of coating formulation for heat-resistant layer):

A coating formulation (UC8) for a heat-resistant layer was prepared by mixing and dissolving the following components:

| | |
|---|---|
| Liquid formulation (UF8) of the film-forming resin (30% solution) | 100 parts |
| Methyl ethyl ketone | 100 parts |

Referential Example 39 (preparation of coating formulation for heat-resistant layer):

A coating formulation (UC9) for a heat-resistant layer was prepared by mixing and dissolving the following components:

| | |
|---|---|
| Liquid formulation (UF9) of the film-forming resin (30% solution) | 100 parts |
| Methyl ethyl ketone | 100 parts |

Referential Example 40 (preparation of coating formulation for heat-resistant layer):

A coating formulation (UC10) for a heat-resistant layer was prepared by mixing and dissolving the following components:

| | |
|---|---|
| Liquid formulation (UF10) of the film-forming resin (30% solution) | 100 parts |
| Methyl ethyl ketone | 100 parts |

Referential Example 41 (preparation of coating formulation for heat-resistant layer):

A coating formulation (VC1) for a heat-resistant layer was prepared by mixing and dissolving the following components:

| | |
|---|---|
| Liquid formulation (VF1) of the film-forming resin (30% solution) | 100 parts |
| Methyl ethyl ketone | 100 parts |

Referential Example 42 (preparation of coating formulation for heat-resistant layer):

A coating formulation (VC2) for a heat-resistant layer was prepared by mixing and dissolving the following components:

| | |
|---|---|
| Liquid formulation (VF2) of the film-forming resin (30% solution) | 100 parts |
| Methyl ethyl ketone | 100 parts |

Referential Example 43 (preparation of coating formulation for heat-resistant layer):

A coating formulation (VC3) for a heat-resistant layer was prepared by mixing and dissolving the following components:

| | |
|---|---|
| Liquid formulation (VF3) of the film-forming resin (30% solution) | 100 parts |
| Methyl ethyl ketone | 100 parts |

Referential Example 44 (preparation of coating formulation for heat-resistant layer):

A coating formulation (VC4) for a heat-resistant layer was prepared by mixing and dissolving the following components:

| | |
|---|---|
| Liquid formulation (VF4) of the film-forming resin (30% solution) | 100 parts |

-continued

| | |
|---|---|
| Methyl ethyl ketone | 100 parts |

Referential Example 45 (preparation of coating formulation for heat-resistant layer):

A coating formulation (VC5) for a heat-resistant layer was prepared by mixing and dissolving the following components:

| | |
|---|---|
| Liquid formulation (VF5) of the film-forming resin (30% solution) | 100 parts |
| Methyl ethyl ketone | 100 parts |

Referential Example 46 (preparation of coating formulation for heat-resistant layer):

A coating formulation (VC6) for a heat-resistant layer was prepared by mixing and dissolving the following components:

| | |
|---|---|
| Liquid formulation (VF6) of the film-forming resin (30% solution) | 100 parts |
| Methyl ethyl ketone | 100 parts |

Referential Example 47 (preparation of coating formulation for heat-resistant layer):

A coating formulation (VC7) for a heat-resistant layer was prepared by mixing and dissolving the following components:

| | |
|---|---|
| Liquid formulation (VF7) of the film-forming resin (30% solution) | 100 parts |
| Methyl ethyl ketone | 100 parts |

Referential Example 48 (preparation of coating formulation for heat-resistant layer):

A coating formulation (VC8) for a heat-resistant layer was prepared by mixing and dissolving the following components:

| | |
|---|---|
| Liquid formulation (VF8) of the film-forming resin (30% solution) | 100 parts |
| Methyl ethyl ketone | 100 parts |

Referential Example 49 (preparation of coating formulation for heat-resistant layer):

A coating formulation (VC9) for a heat-resistant layer was prepared by mixing and dissolving the following components:

| | |
|---|---|
| Liquid formulation (VF9) of the film-forming resin (30% solution) | 100 parts |
| Methyl ethyl ketone | 100 parts |

Referential Example 50 (preparation of coating formulation for heat-resistant layer):

A coating formulation (VC10) for a heat-resistant layer was prepared by mixing and dissolving the following components:

| | |
|---|---|
| Liquid formulation (VF10) of the film-forming resin (30% solution) | 100 parts |
| Methyl ethyl ketone | 100 parts |

EXAMPLES 1-10

The coating formulations UC1-UC10 obtained in the Referential Examples were separately coated by a gravure coater on the back sides of 15-μm thick polyester films, on the front sides of which a heat-sensitive recording layer had been formed in advance, to give a dry coat thickness of 0.6 μm. The solvent was then driven off in an oven to form heat-resistant layers. The thus-prepared films were separately cut into a predetermined width, whereby heat-sensitive recording media of this invention were obtained

EXAMPLES 11-20

The coating formulations VC1-VC10 obtained in the Referential Examples were separately coated by a gravure coater on the back sides of 15-μm thick polyester films, on the front sides of which a heat-sensitive recording layer had been formed in advance, to give a dry coat thickness of 0.6 μm. The solvent was then driven off in an oven to form heat-resistant layers. The thus-prepared films were separately cut into a predetermined width, whereby heat-sensitive recording media of this invention were obtained.

COMPARATIVE EXAMPLES 1-2

For the sake of comparison, heat-sensitive recording media were obtained in the same manner as in Example 1 except that a polyurethane resin not modified by any modifier of this invention and Eslek A were used respectively.

Application Example

Certain properties of the heat-sensitive recording media of the above Examples and Comparative Examples were investigated. The following results were obtained. The following properties were ranked by using the heat-sensitive recording media in an actual heat-sensitive recording test.

Sticking tendency was ranked in 5 stages, the lowest sticking tendency receiving a "5", by visually observing the separability between a thermal head and a heat-sensitive recording medium upon pressing of the thermal head and its subsequent release.

Head smearing was ranked similarly, the least smearing receiving a "5", by observing the degree of smearing of a thermal head.

| Recording medium | Sticking tendency | Head smearing |
|---|---|---|
| Comp. Ex. 1 | 1 | 2 |
| Ex. 1 | 4 | 5 |
| Ex. 2 | 5 | 5 |
| Ex. 3 | 5 | 5 |
| Ex. 4 | 5 | 5 |
| Ex. 5 | 4 | 4 |
| Ex. 6 | 4 | 5 |
| Ex. 7 | 5 | 5 |
| Ex. 8 | 5 | 5 |
| Ex. 9 | 5 | 5 |
| Ex. 10 | 4 | 4 |
| Comp. Ex. 2 | 2 | 3 |
| Ex. 11 | 5 | 5 |
| Ex. 12 | 5 | 4 |
| Ex. 13 | 5 | 5 |
| Ex. 14 | 4 | 5 |
| Ex. 15 | 4 | 5 |
| Ex. 16 | 5 | 5 |
| Ex. 17 | 5 | 5 |
| Ex. 18 | 5 | 5 |
| Ex. 19 | 5 | 5 |
| Ex. 20 | 4 | 5 |

It is clear from the above results that the heat-resistant layers of heat-sensitive recording media according to this invention have low sticking tendency and cause little head smearing.

Having now fully described the invention, it will be apparent to one of ordinary skill in the art that many changes and modifications can be made thereto without departing from the spirit or scope of the invention as set forth herein.

We claim:

1. In a heat-sensitive recording medium composed of a base sheet, a heat-sensitive recording layer provided on one side of the base sheet and a heat-resistant layer provided on the other side of the base sheet, the improvement wherein the heat-resistant layer is made of a film-forming resin modified with a modifier which is a reaction product of a silicone, wherein said silicone compound (a) contains at least one organic functional group reactive with an isocyanate group and is reacted with an organic polyisocyanate.

2. The heat-sensitive recording medium as claimed in claim 1, wherein the modifier is substantially free of free isocyanate group.

3. The heat-sensitive recording medium as claimed in claim 1, wherein the modifier contains at least one free isocyanate group.

* * * * *